US008480365B2

(12) United States Patent
Ochoa

(10) Patent No.: US 8,480,365 B2
(45) Date of Patent: Jul. 9, 2013

(54) CAP HAVING PIVOTABLY MOVABLE FAN

(76) Inventor: Robert Ochoa, Los Angeles, CA (US)

( * ) Notice: Subject to any disclaimer, the term of this patent is extended or adjusted under 35 U.S.C. 154(b) by 516 days.

(21) Appl. No.: 12/778,492

(22) Filed: May 12, 2010

(65) Prior Publication Data

US 2011/0280726 A1 Nov. 17, 2011

Related U.S. Application Data

(63) Continuation-in-part of application No. 12/103,055, filed on Apr. 15, 2008, now abandoned, and a continuation-in-part of application No. 12/183,587, filed on Jul. 31, 2008, now abandoned.

(60) Provisional application No. 60/963,334, filed on Aug. 3, 2007.

(51) Int. Cl.
*F04D 29/00* (2006.01)
*A42C 5/04* (2006.01)

(52) U.S. Cl.
USPC ..... 416/63; 416/146 R; 417/234

(58) Field of Classification Search
USPC 2/171.3; 416/63, 146 R, 246, 247 R; 439/10, 439/11, 12, 13, 23, 29, 31, 37, 248, 607.29; 417/234
See application file for complete search history.

(56) References Cited

U.S. PATENT DOCUMENTS 5,425,620 A * 6/1995 Stroud ..... 416/63
5,542,850 A * 8/1996 Frantz ..... 439/31
6,032,291 A * 3/2000 Asenguah et al. ..... 2/171.3
7,317,269 B2 * 1/2008 Boyland et al. ..... 310/71

* cited by examiner

*Primary Examiner* — Edward Look
*Assistant Examiner* — Christopher J Hargitt
(74) *Attorney, Agent, or Firm* — Jordan IP Law, LLC; Todd A. Vaughn

(57) ABSTRACT

An article of headwear having a body with a hole extending completely through bottom and top surfaces thereof and a cooling device mounted to the article of headwear. The cooling device is mounted via a mounting ring received at the hole which mounts the cooling device to the body at the through hole to permit selective manipulation of the cooling device about a horizontal axis in a range between 0 to 360 degrees relative to the headwear body and the mounting ring.

19 Claims, 11 Drawing Sheets

CAP HAVING PIVOTABLY MOVABLE FAN

CROSS-REFERENCE TO RELATED APPLICATIONS

Figure 1:
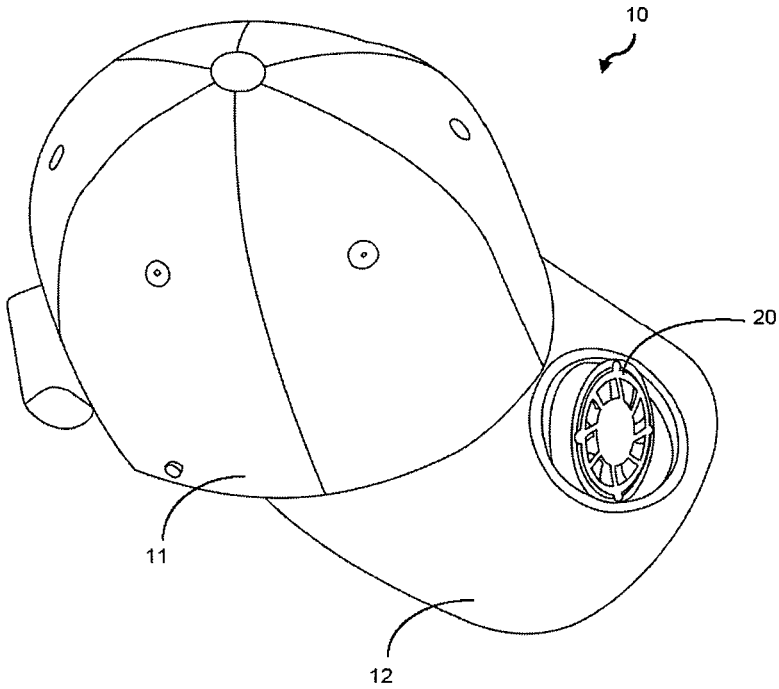

The present application is a continuation-in-part of U.S. patent application Ser. No. 12/103,055 (filed on Apr. 15, 2008)now abandoned, and U.S. patent application Ser. No. 12/183,587 (filed on Jul. 31, 2008)now abandoned, which each respectively claim priority to U.S. Provisional Application Ser. No. 60/963,334 (filed Aug. 3, 2007), each of whose contents are respectively incorporated by reference in their complete entireties.

BACKGROUND

Various types of headwear such as hats, caps and the like may be equipped with a battery-driven fan provided at the visor or lid for cooling the wearer. Such designs, however, do not provide a robust mounting of the fan to the lid using a minimal amount of parts. The use of many parts, of course, increases overall manufacturing costs. The increase in overall manufacturing costs, in turn, increases the wholesale and/or retail price of the product.

Moreover, the fan is generally attached to the visor or lid without permitting rotation or pivoting. In instances where the fan is moveable by the wearer, it requires disconnecting or detaching the fan from the cap in order to place it at a different position. The range of movement is also minimal due to the mechanical connection of various parts and/or the presence of the wiring connection between electrical components, e.g., the fan, switch the driving source and the power source. Particularly, the wiring connection between the various electrical components results in entanglement of the wires, which in turn can result in shorting and/or severing of the wires.

The use of exposed wiring is not only aesthetically undesirable, but also functionally undesirable due to the likelihood of electrical shorts.

Lastly, because the electrical components are generally exposed to the elements, the driving source, and thus, the functionality of the fan, will be compromised if the cap is worn during rain, snow, sleet and misty conditions.

Accordingly, there is a need to mitigate or otherwise reduce the aforementioned limitations.

SUMMARY

In view of the foregoing, embodiments are related to an article of headwear such as a cap, hat or the like including a crown for receiving a head of a wearer and a lid portion connected to a front portion of the crown. Particularly, the cap can include at least one of the following: a cooling device pivotably mounted to the lid, the cooling device having a plurality of rotatable blades for providing currents of air and a driving source such as a motor for driving the plurality of rotatable blades. The cooling device is adapted for full rotation or pivoting about an axis, i.e., between 0 to 360 degrees, relative to the cap either during activation or deactivation.

Embodiments are related to a cap having a crown and a lid extending from the crown, the cap including at least one of the following: a through hole extending completely through the lid; a cooling device; and a mounting ring received at the through hole which mounts the cooling device to the headwear body at the through hole to permit selective manipulation of the cooling device about a horizontal axis in a range between 0 to 360 degrees relative to the headwear body and the mounting ring.

Embodiments are related to an article of headwear including at least one of the following: a headwear body having a headwear hole extending completely there through; a mounting ring mounted to the headwear body and concentrically received in the headwear hole, the mounting ring having a mounting ring hole that is concentric to the headwear hole; a cooling device bracket concentrically received in the mounting ring hole and pivotally connected to the mounting ring; and a cooling device mounted to the cooling device bracket, the cooling device bracket including a pair of terminals which permit activation of the cooling device and rotation of the cooling device when the cooling is mounted in the cooling device bracket.

Embodiments are related to a cap having at least one of the following: a lid having a lid hole of circular cross-section extending completely therethrough; a mounting ring concentrically received at the lid hole, the mounting ring including a mounting ring body defining a mounting ring hole that is concentric to the lid hole, a pair of flanges extending spaced apart from an outer peripheral edge of the mounting ring body to define a gap that engages the lid to thereby mount the mounting ring to the lid; and a cooling device concentrically received at the mounting ring hole, the cooling device including a cooling device bracket concentrically received by the mounting ring at the mounting ring hole, and a pair of cooling device terminals extending from the cooling device bracket to mount and support the cooling device at the mounting ring. In accordance with embodiments, the cooling device terminals define a horizontal axis of rotation about which the cooling device can pivot during activation or deactivation of the cooling device.

Embodiments are related to an article of headwear having at least one of the following: a headwear body having a through hole extending completely therethrough, a cooling device; and a mounting ring received at the through hole which mounts the cooling device to the headwear body at the through hole to permit pivoting movement of the cooling device about a horizontal axis relative to the headwear body and the mounting ring at least during activation of the cooling device in a range between 0 to 360 degrees.

Embodiments are related to an article of headwear having at least one of the following: a headwear body having a headwear hole extending completely therethrough; a mounting ring mounted to the headwear body and concentrically received in the headwear hole, the mounting ring having a mounting ring hole that is concentric to the headwear hole; a cooling device bracket concentrically received in the mounting ring hole and pivotally connected to the mounting ring such that the cooling device bracket includes a pair of terminals which permit activation and pivoting of the cooling device when the cooling device; and a cooling device mounted in the cooling device bracket.

Embodiments are related to an article of headwear having at least one of the following: a mounting ring attached to the article of headwear, the mounting ring including a mounting ring body defining a mounting ring hole, a pair of flanges extending spaced apart from an outer peripheral edge of the mounting ring body to define a gap that engages the article of headwear to thereby mount the mounting ring to the article of headwear; and a cooling device including a cooling device bracket concentrically received by the mounting ring at the mounting ring hole and by which the cooling device is mounted, and a pair of cooling device terminals extending from the cooling device bracket to mount and support the cooling device to the mounting ring, the cooling device terminals permitting activation of the cooling device and also define a horizontal axis of rotation about which the cooling device can pivot at least during activation of the cooling device.

The cooling device may include a fan having a fan body and a plurality of fan blades that are driven when the fan motor is activated. The fan motor is electrically connected to a power source such as a dry cell battery that is connected to an inner surface of the crown.

The cooling device can include a guard secured to the top portion in order to prevent moisture and/or debris from entering the cooling device. This can permit the fan to be activated during instances of inclimate weather and thereby prevent the cooling device from shutting off due to the entry of rain, snow or debris. The cap may also be used to prevent the entry of sand, smoke and/or dust particles.

These and other objects, features and advantages of the invention will become more apparent from the following description when taken in conjunction with the detailed drawings that show, for purposes of illustration only, the preferred embodiments of the invention.

DRAWINGS

Example FIGS. 1-15 illustrate an article of headwear having a cooling device adapted for selective manipulation to permit rotation or pivoting in a range between 0 to 360 degrees, in accordance with embodiments.

DESCRIPTION

In accordance with embodiments, an article of headwear such as a cap, hat, helmet and the like having a cooling device such as a fan mounted therein. As will be further explained in detail hereinbelow, in accordance with embodiments, the cooling device is mounted to the cap in a manner that permits selective pivoting in a range between 0 to 360 degrees about a horizontal axis. Such full-range pivoting action permits a user to selective direct air currents towards or away the body of the user.

As illustrated in example FIG. 1, cap 10 includes crown 11 and lid 12 connected or attached to crown 11. Lid 12 can be provided with cooling device 20 to direct air currents towards or away from the body of a wearer of cap 10. In order to permit the mounting of cooling device 20 to cap 10, lid 12 has a through hole provided therein which extends completely through the upper and lower surfaces of lid 12. Mounting ring 30 is mounted to lid 12 at the through hole. Cooling device 20 is mounted to cooling device bracket 40 which in turn is pivotally connected to mounting ring 30. In accordance with embodiments, cooling device 20, via the connection between cooling device bracket 40 and mounting ring 30, can selectively move or pivot about a horizontal axis in a full-range of motion between 0 to 360 degrees during activation or deactivation.

Figure 2:
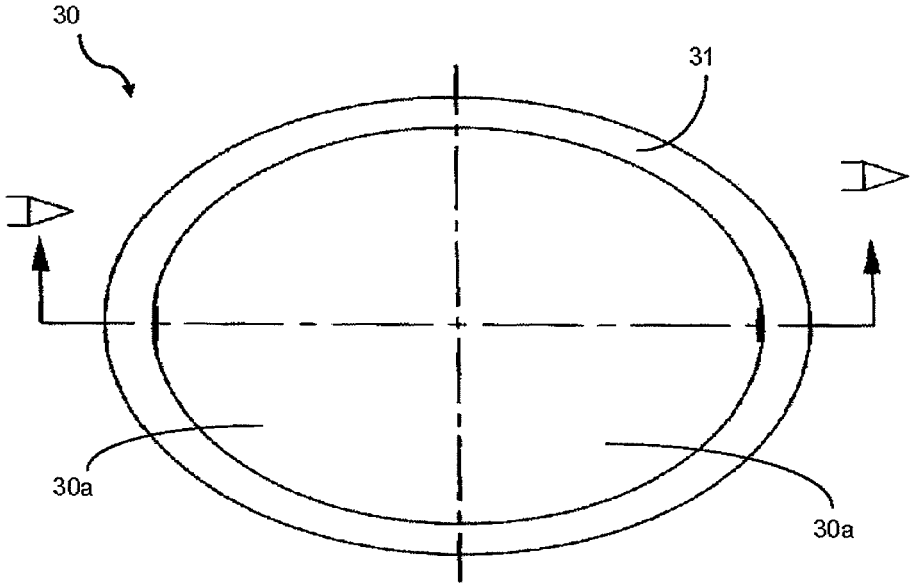
Figure 3:
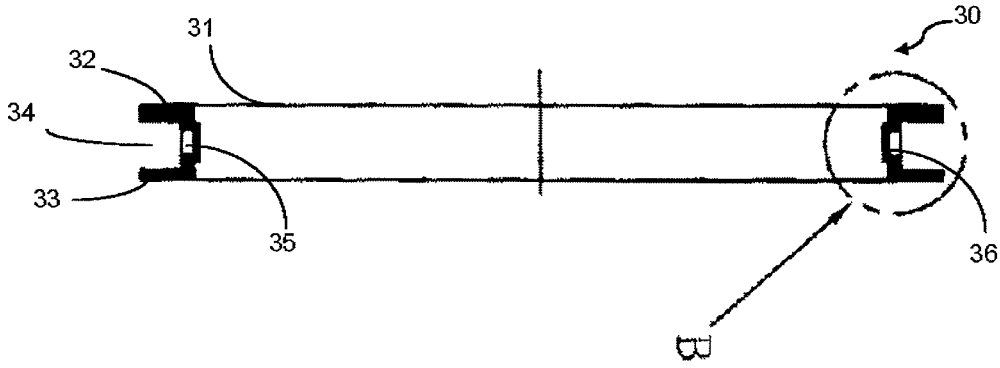

As illustrated in example FIGS. 2 and 3, mounting ring 30 includes mounting ring body 31 having a generally circular cross-section which defines a hole 30*a* that lies concentrically with the through hole of lid 12. As illustrated in example FIG. 3, mounting ring body 31 has first and second holes or apertures 35, 36 extending through respective vertical sidewalls of gap 34.

As illustrated in example FIGS. 4-6, hole 30*a* of mounting ring 30 is adapted to concentrically receive cooling device 20 via at least a mechanical connection as will be explained hereinbelow to permit full rotation or pivoting in a range between 0 to 360 degrees about at least a horizontal axis relative to lid 12. Mounting ring body 31 also includes first flange 32 which extends from an upper outer peripheral edge of mounting ring body 31. Second flange 33 extends from a lower outer peripheral edge of mounting ring body 31 and is spaced a predetermined spatial distance from first flange 32 to create gap 34. The predetermined spatial distance defining the size of gap 34 is preferably approximately 3.9 mm, but is not limited thereto. In order to mount cooling device 20 to lid 12 via mounting ring 30, the peripheral edges of lid 12 at the through hole are received into gap 34 such that a vertical wall of mounting ring 30 at gap 34 engages and contacts an inner peripheral vertical surface wall of lid 12 at the through hole and first flange 32 and second flange 33 engage and contact the uppermost and lowermost lateral surfaces of lid 12 at the through hole, respectively.

Figure 8:
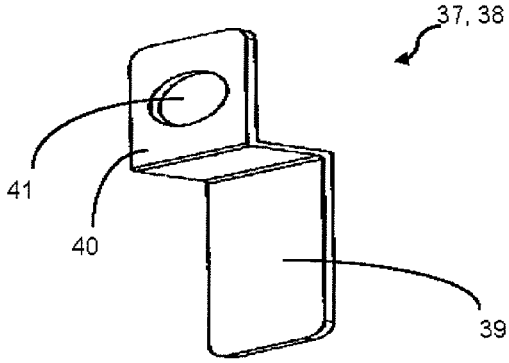
Figure 9:
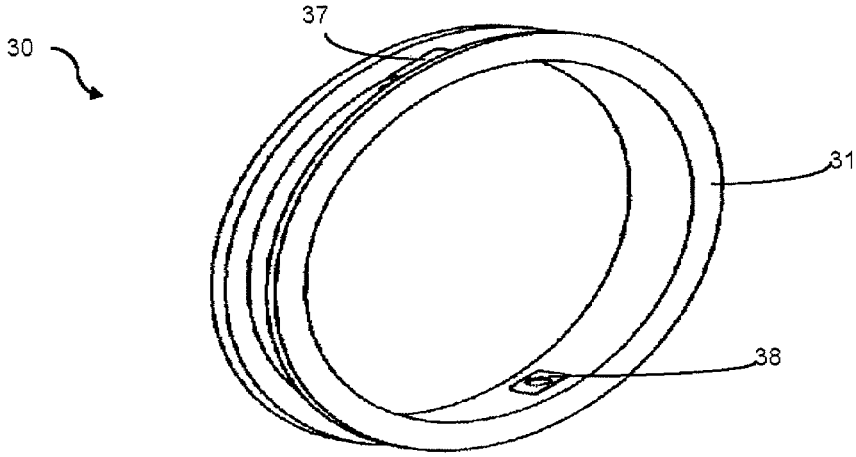

As illustrated in example FIGS. 8 and 9, to permit electric actuation of cooling device 20, mounting ring 30 is provided with one or more electric contacts such as first mounting ring electric contact 37 provided at a first circumferential region of mounting ring body 31 and second mounting ring electric contact 38 provided at a second circumferential region of mounting ring body 31. The first circumferential region is spatially positioned opposite to and spaced from the second circumferential region.

As illustrated in example FIG. 8, mounting ring electric contacts 37, 38 may each include first mounting ring electric contact portion 39 which extends through mounting ring body 31 to thereby mount each mounting ring electric contact 37, 38 to mounting ring body 31 at the respective circumferential region. Second mounting ring electric contact portion 40 may extend from first mounting ring electric contact portion 39 adjacent an inner peripheral surface of mounting ring body 31. Second mounting ring electric contact 40 includes hole 41 that concentrically correspond to apertures 35, 36 of mounting ring 30. In accordance with embodiments, an intermediate contact section may extend between mounting ring electric contacts 37, 38 such that second mounting ring electric contact portion 40 extends generally parallel to first mounting ring electric contact portion 39. Alternatively, second mounting ring electric contact portion 40 may extend directly from first mounting ring electric contact 39 to thereby extend generally perpendicularly from first mounting ring electric contact portion 39 adjacent an inner peripheral surface of mounting ring body 31.

Mounting ring 30, other than mounting ring electric contact 37, 38, may be composed of a lightweight, non-conductive, resilient, material. Such material may be moldable. For instance, mounting ring 30 can be composed of a polymeric material, a composite material or combinations thereof. While mounting ring body 31 is illustrated having a generally circular cross-section, it may formed to have rectangular cross-section or any other cross-section which permits mounting of cooling device 20 to lid 12 in a manner which permits pivoting movement of cooling device 20 in a range between 0 to 360 degrees during activation or deactivation.

Figure 10:
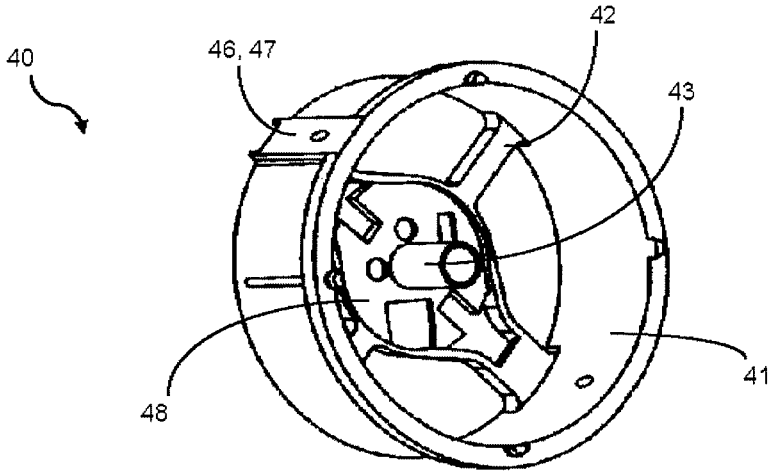

As illustrated in example FIG. 10, cooling device bracket 40 is concentrically received in mounting ring hole 30*a* and pivotally connected to mounting ring body 31. In accordance with embodiments, cooling device bracket 40 includes a body having a geometric shape or cross-section which corresponds to the geometric shape or cross-section of mounting ring 30. Cooling device bracket 40 has a generally circular cross-section with sidewalls 41 and seat or base wall 42 at a center thereof. Base wall 42 has a plurality of vent openings. Sidewalls 41 define a space partially enclosed at one end by base wall 42 which receives the fan via stem 43 which protrudes from base wall 42. A driving source 48 such as an electric motor is provided at base wall 42. Driving source 42 may be integrally connected or otherwise attached to base wall 42.

Figure 6:
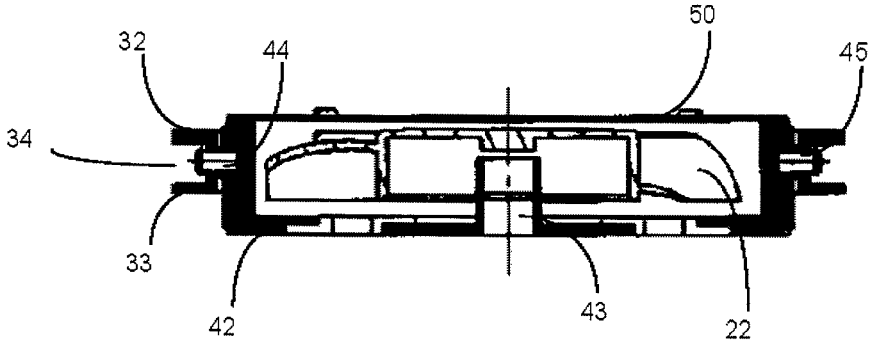
Figure 7:
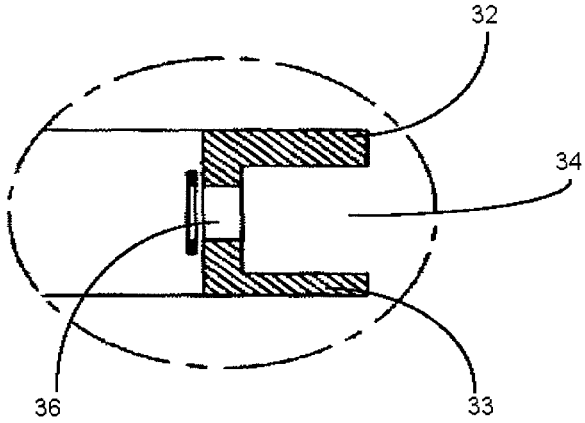

As illustrated in example FIGS. 6 and 10, cooling device holder 40 also includes first and second cooling device terminals 44, 45 and first and second cooling device electric contacts 46, 47 at an outer periphery thereof. First cooling device terminal 44 and second cooling device terminal 45 each protrude or extend generally perpendicularly from cooling device holder 40 and through a respective aperture 35, 36 of mounting ring body 31 and hole 41 of second mounting ring electric contact portion 39 to electrically connect driving source 48 to switch and/or a power source (not shown). First and second cooling device electric contacts 46, 47 each include a horizontal member and a vertical member extended generally perpendicularly from the horizontal member. The horizontal member is positioned adjacent base wall 42 and electrically connects cooling device electric contact 46, 47 by wiring to driving source 48. The vertical member is positioned adjacent sidewalls 41 and include a hole through which a respective cooling device terminal 44, 45 protrudes to establish an electrical connection through which current may flow while also creating a mechanical connection between cooling device electric contact 46, 47 and cooling device holder 40.

Electric wiring (not shown) may be connected at one end to a respective cooling device terminal 44, 45 and at the other end to a power source, switch and the like. This permits selective actuation or deactivation of cooling device 20. Moreover, due to the mechanical connection between first and second cooling device terminals 23, 24, a horizontal axis is created by which cooling device 20 may pivot relative to lid 12 in a range between 0-360 degrees.

Figure 4:
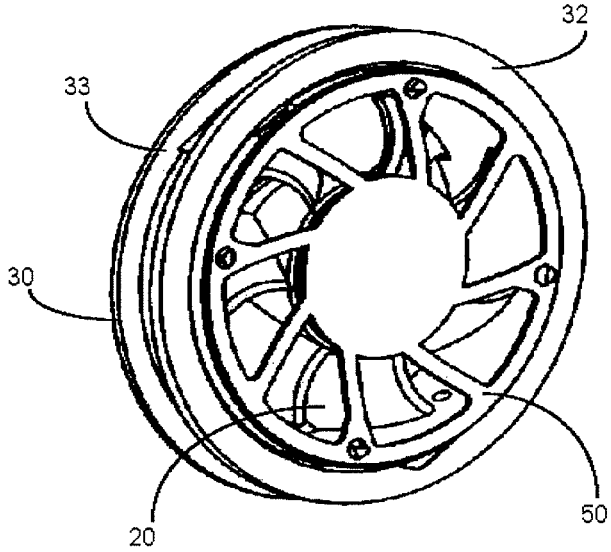
Figure 5:
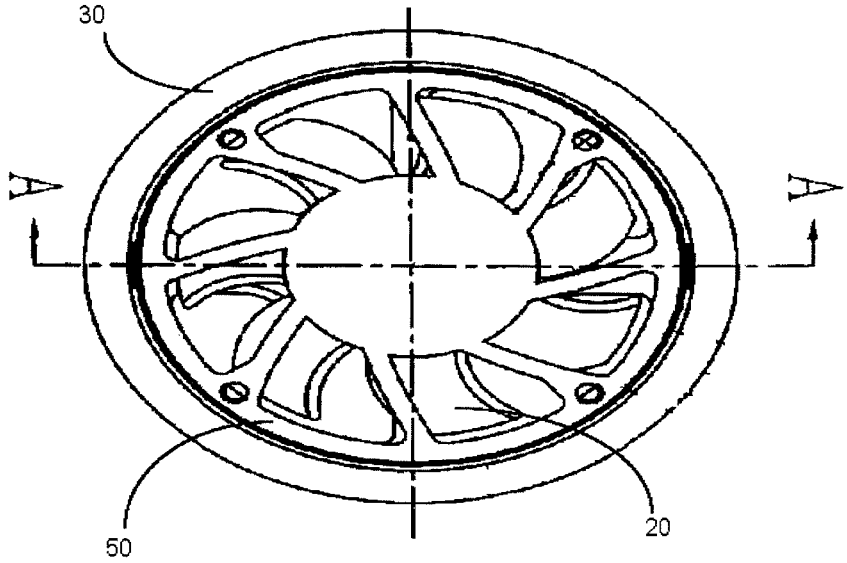

As illustrated in example FIGS. 4-6, cooling device 20 is sized for attachment to lid 12 by way of mounting ring 30 and partially enclosed at an upper portion thereof by guard 50. In accordance with embodiments, mounting ring 30 is received and mounted at the through hole in lid 12. In accordance with embodiments, cooling device 20 includes a fan body and a plurality of rotateable fan blades which are rotateably driven by driving source 48 when actuated by a switch. Cooling device 20 may be composed of durable materials such as polymers, composites and combinations thereof. Cooling device 20 and driving source 48 such as a motor are also in electric communication by wiring with a power source and/or switch. The power source can be at least one of one or more solar panels or one or more dry cell batteries. The switch permits activation or deactivation of cooling device 20. The switch may be an on/off switch or a variable switch. Fan 22 is in electric communication either by wiring connection or wirelessly to driving source 48 provided at base wall 42.

Figure 11:
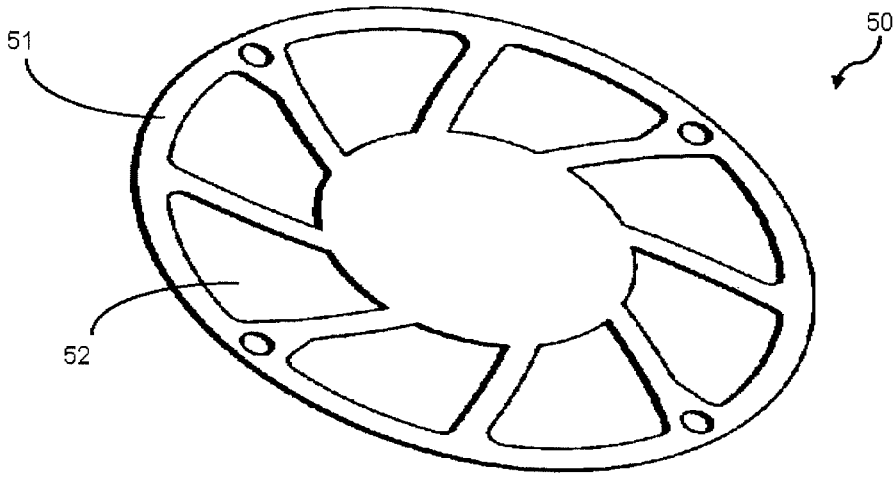
Figure 12:
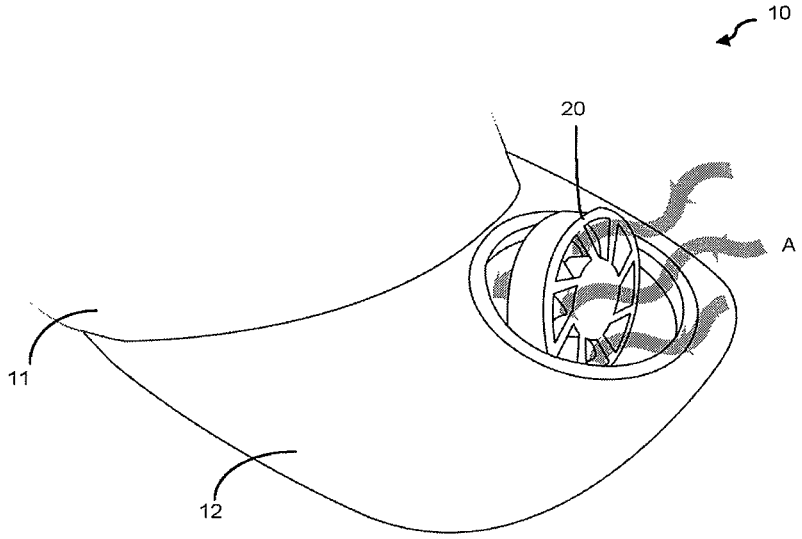
Figure 13:
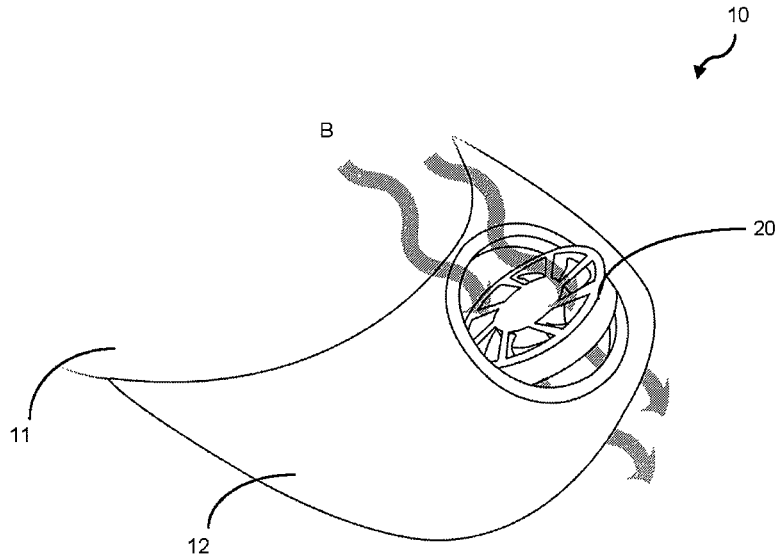
Figure 14:
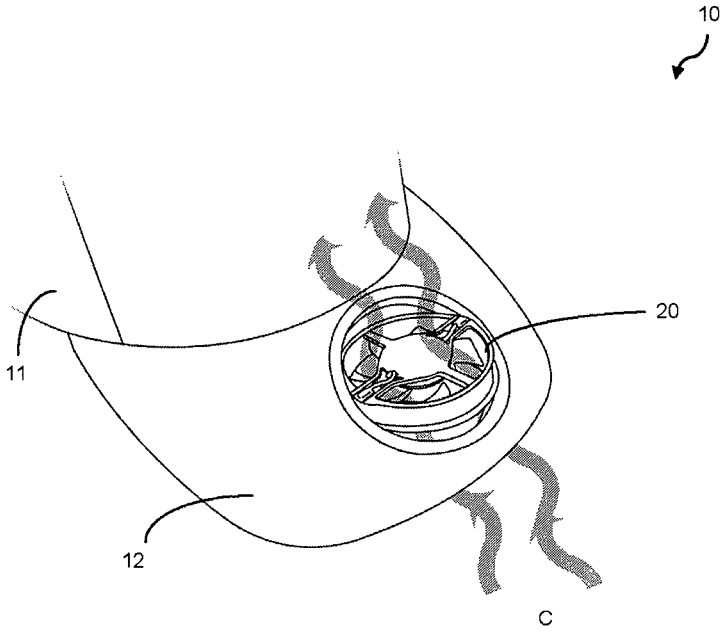
Figure 15:
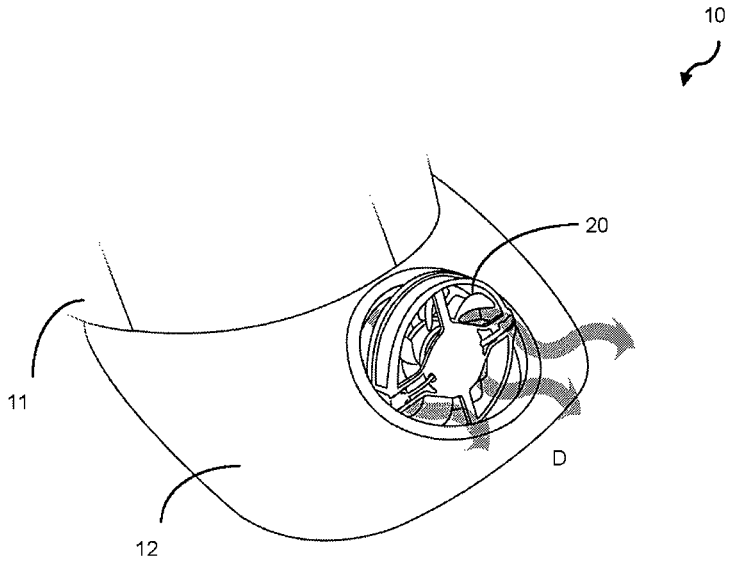

As illustrated in example in example FIG. 11, protective guard 50 is secured on and/or over cooling device 20 for protecting the inadvertent entry of fingers and the like into the cooling device 20 which may result in injury. Guard 50 may also serve to prevent from undue moisture, particles and/or debris which may prematurely terminate operation or otherwise shut off cooling device 20. Guard 50 having a generally circular cross-sectioned base 51 with a plurality of vented openings 52. Guard 50 can be composed of may be composed of durable, non-conductive materials such as polymers, composites and combinations thereof.

As illustrated in example in example FIGS. 12-15, in accordance with embodiments, cap 10 having cooling device 20 that is mounted to lid 12 in a manner permitting selective manipulation by rotating and/or pivoting relative to lid 12 without causing tangling of wires. Such selective manipulation of cooling device 20 can occur in a range between approximately 0-360 degrees movement relative to the uppermost surface of lid 12 when in activation (or deactivation) in order to direct localized, cool ambient currents of air towards or away from the body of the wearer. Such selective manipulation of cooling device 20 can also result in an increase or decrease in the rate of flow of air currents depending upon the degree of rotation or pivoting.

Cooling device 20 can be selectively manipulated, for example, from a normal position to various positions such that currents of air may be directed at varying directions A, B, C, and D relative to the lid, cap and/or body of the wearer. For example, as illustrated in example FIGS. 12 and 14, cooling device 20 can be selectively manipulated to direct currents of air towards the wearer, for example, to cool specific areas of the body of the wearer. Moreover, as illustrated in example FIGS. 13 and 15, cooling device 20 can be selectively manipulated to direct currents of air away from the wearer, for example, to remove unwanted dust particles, smoke, debris and the like to thereby open a visual path for wearer and/or to permit unrestricted breathing where necessary.

In accordance with embodiments, selective manipulation of the cooling device can be effectuated manually and/or automatically. Any such automatic selective manipulation can be done by direct wire connection or wirelessly.

Moreover, the article of headwear may include a cooling device in electrical communication with one or more sensing mechanisms which detects body heat and/or air temperature. Each sensing mechanism may be positioned on the body of the wearer and/or connected or attached to a specific area of the headwear or other clothing article. For example, if the detected or sensed temperature reaches a predetermined temperature and/or temperature range, the cooling device may be automatically actuated via the electrical connection between sensing mechanism and switch and/or drive source.

While embodiments of the cap are illustrated having a cooling device, mounting ring, cooling device holder and cooling device guard as separate components, embodiments are not limited thereto. For example, for purposes of manufacturing efficiency and reduction in manufacturing costs, the cooling device, mounting ring, cooling device holder, cooling device guard and any combination thereof may be manufactured as a single, integrated unit.

In accordance with embodiments, in order to permit the wearer to see during poorly lit situations, the cooling device can be composed of a transparent material provided with one or more illuminators which project light. Such illuminators can take the form of a plurality of light emitting diodes (LEDs) that project light with a minimum amount of electric energy. The LEDs may be programmable to change colors. In such case, fan body can be electrically connected to the driving source causing the fan blades to rotate and also project light when activated.

In accordance with embodiments, the cap may not only include a cooling device as described hereinabove, but may additionally or in the alternative also include one or more heating devices for providing sufficient heat and comfort to the head of the wearer. Such a heating device can include a plurality of electrical resistance heaters electrically connected to a printed circuit element such as wiring which delivers an electrical current thereto. The resistance heaters of the heating device can have a predetermined resistance of sufficient to generate localized heat to the head of the wearer. The printed circuit element, i.e., the wiring of the heating device can be electrically connected to a second power source such as at least one dry cell battery. Alternatively, the heating device may be electrically connected to the same power source as the cooling device. While embodiments illustrate a cap having a cooling device and a heating device for providing cooling and heating to a wearer, respectively, cap may include only a heating configuration as described herein.

Although embodiments have been described herein, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

In addition to variations and modifications in the component parts and/or arrangements, alternative uses will also be apparent to those skilled in the art.

What is claimed is:

1. An article of headwear comprising:

a headwear body having a through hole extending completely therethrough;

a cooling device;

a mounting ring received at the through hole which mounts the cooling device to the headwear body at the through hole to permit selective manipulation of the cooling device about a horizontal axis in a range between 0 to 360 degrees relative to the headwear body and the mounting ring, the mounting ring having:

a mounting ring body having a first aperture provided at the gap and a second aperture at the gap concentrically spaced from the first aperture at an opposite side of the mounting ring body;

a first flange extending generally perpendicularly from an upper outer peripheral edge of the mounting ring body which engages the headwear body; and a second flange extending generally perpendicularly from a lower outer peripheral edge of the mounting ring body which engages the headwear body, the second flange being spaced from the first flange to define a gap that receives and engages the headwear body;

a first mounting ring electric contact provided at a first region of the mounting ring body and a second mounting ring electric contact provided at a second region of the mounting ring body, wherein the first region is opposite to and spaced from the second region, the first mounting ring electric contact having:

a first mounting ring electric contact portion extending through the mounting ring body to thereby mount the first mounting ring electric contact to the mounting ring body at the first region; and a second mounting ring electric contact portion extending generally perpendicularly from the first mounting ring electric contact portion adjacent an inner peripheral surface of the mounting ring body, the second mounting ring electric contact portion including a hole that corresponds spatially to the first aperture;

a driving source for driving the cooling device.

2. The article of headwear of claim 1, wherein the cooling device comprises:

a cooling device bracket mounted to and concentrically received by the mounting ring;

a fan including a fan body and a plurality of rotatable fan blades;

a first cooling device terminal extending from the cooling device bracket and through the first aperture and the hole of the second mounting ring electric contact portion the cooling device bracket;

a second cooling device terminal extending from the cooling device bracket and through the second aperture;

a first cooling device electric contact electrically connected to the first cooling device terminal and the driving source; and a second cooling device electric contact electrically connected to the second cooling device terminal and the driving source.

3. The article of headwear of claim 2, wherein the first cooling device electric contact and the second cooling device electric contact are mounted respectively via the first cooling device terminal and the second cooling device terminal at an outer peripheral surface of the cooling device bracket.

4. The article of headwear of claim 1, wherein the cooling device pivots about the first and second cooling device terminals.

5. An article of headwear comprising:

a headwear body having a headwear hole extending completely therethrough;

a mounting ring mounted to the headwear body and concentrically received in the headwear hole, the mounting ring having:

a mounting ring hole that is concentric to the headwear hole;

a mounting ring body;

a first flange extending generally perpendicularly from an upper outer peripheral edge of the mounting ring body;

a second flange extending generally perpendicularly from a lower outer peripheral edge of the mounting ring body and spaced from the first flange to define a gap that receives and engages an inner surface of the headwear body at the through hole, the mounting ring body having a first aperture provided at the gap and a second aperture at the gap concentrically spaced from the first aperture at an opposite side of the mounting ring body;

a first mounting ring electric contact provided at a first region of the mounting ring body, the first mounting ring electric contact having a first mounting ring electric contact portion extending through the mounting ring body to thereby mount the first mounting ring electric contact to the mounting ring body at the first region, and a second mounting ring electric contact portion extending generally perpendicularly from the first mounting ring electric contact portion adjacent an inner peripheral surface of the mounting ring body, the second mounting ring electric contact portion including a hole that corresponds spatially to the first aperture; and a second mounting ring electric contact provided at a second region of by the mounting ring body, wherein the first region is opposite to and spaced from the second region, the second electric contact having a third mounting ring electric contact portion extending through the mounting ring body to thereby mount the second mounting ring electric contact to the mounting ring body at the second region, and a fourth mounting ring electric contact portion extending generally perpendicularly from the third mounting ring electric contact portion adjacent an inner peripheral surface of the mounting ring body, the fourth mounting ring electric contact portion including a hole that corresponds spatially to the second aperture;

a cooling device bracket concentrically received in the mounting ring hole and pivotally connected to the mounting ring, the cooling device bracket including a pair of terminals; and a cooling device mounted in the cooling device bracket, wherein the terminals of the cooling device bracket permit activation and selective pivoting of the cooling device.

6. The article of headwear of claim 5, wherein the cooling device pivots in a range between 0 to 360 degrees relative to the headwear body.

7. The article of headwear of claim 5, wherein the first cooling device electric contact and the second cooling device electric contact are mounted respectively via the first cooling device terminal and the second cooling device terminal at an outer peripheral surface of the cooling device bracket.

8. An article of headwear comprising:

a mounting ring attached to the article of headwear, the mounting ring including a mounting ring body defining a mounting ring hole, a pair of flanges extending spaced apart from an outer peripheral edge of the mounting ring body to define a gap that engages the article of headwear to thereby mount the mounting ring to the article of headwear;

a mounting ring electric contact having:

a first mounting ring electric contact portion extending through the mounting ring body to thereby mount the mounting ring electric contact to the mounting ring body; and a second mounting ring electric contact portion extending generally perpendicularly from the first mounting ring electric contact portion adjacent an inner peripheral surface of the mounting ring body, the second mounting ring electric contact portion including a hole that corresponds spatially to a first aperture in the mounting ring body; and a cooling device including a cooling device bracket concentrically received by the mounting ring at the mounting ring hole and by which the cooling device is mounted, and a pair of cooling device terminals extending from the cooling device bracket to mount and support the cooling device to the mounting ring, wherein the cooling device terminals permit activation of the cooling device and also define a horizontal axis of rotation about which the cooling device can pivot at least during activation of the cooling device.

9. The article of headwear of claim 8, further comprising a driving source for driving the cooling device, the driving source being mounted at the cooling device bracket.

10. The article of headwear of claim 9, wherein the cooling device terminals permit the electrical connection between the driving source and the cooling device.

11. The article of headwear of claim 8, wherein the cooling device pivots in a range between 0 to 360 degrees relative to the article of headwear.

12. The article of headwear of claim 8, wherein the cooling device comprises a fan.

13. The article of headwear of claim 8, further comprising a first cooling device terminal extending from the cooling device bracket and through the first aperture and the hole of the second mounting ring electric contact portion the cooling device bracket.

14. The article of headwear of claim 13, further comprising a second cooling device terminal extending from the cooling device bracket.

15. The article of headwear of claim 13, further comprising a first cooling device electric contact electrically connected to the first cooling device terminal.

16. The article of headwear of claim 14, further comprising a second cooling device electric contact electrically connected to the second cooling device terminal.

17. The article of headwear of claim 8, wherein the first cooling device electric contact and the second cooling device electric contact are mounted respectively via the first cooling device terminal and the second cooling device terminal at an outer peripheral surface of the cooling device bracket.

18. The article of headwear of claim 8, further comprising:

a first cooling device terminal extending from the cooling device bracket and through the first aperture and the hole of the second mounting ring electric contact portion the cooling device bracket; and a second cooling device terminal extending from the cooling device bracket.

19. The article of headwear of claim 18, wherein the cooling device pivots about the first cooling device terminal and the second cooling device terminal.

* * * * *